US010458295B2

(12) United States Patent
Lahr

(10) Patent No.: US 10,458,295 B2
(45) Date of Patent: Oct. 29, 2019

(54) VALVE TRAIN DEVICE, INTERNAL COMBUSTION ENGINE COMPRISING A VALVE TRAIN DEVICE AND METHOD FOR OPERATING A VALVE TRAIN DEVICE

(71) Applicant: Daimler AG, Stuttgart (DE)

(72) Inventor: Matthias Lahr, Schwaebisch Gmuend (DE)

(73) Assignee: Daimler AG, Stuttgart (DE)

( * ) Notice: Subject to any disclaimer, the term of this patent is extended or adjusted under 35 U.S.C. 154(b) by 92 days.

(21) Appl. No.: 15/748,008

(22) PCT Filed: Jun. 17, 2016

(86) PCT No.: PCT/EP2016/001025
§ 371 (c)(1),
(2) Date: Jan. 26, 2018

(87) PCT Pub. No.: WO2017/016625
PCT Pub. Date: Feb. 2, 2017

(65) Prior Publication Data

US 2019/0010840 A1 Jan. 10, 2019

(30) Foreign Application Priority Data

Jul. 29, 2015 (DE) ..... 10 2015 009 877

(51) Int. Cl.
*F01L 13/06* (2006.01)
*F01L 13/00* (2006.01)
*F01L 1/047* (2006.01)

(52) U.S. Cl.
CPC ..... *F01L 13/06* (2013.01); *F01L 13/0036* (2013.01); *F01L 2001/0473* (2013.01)

(58) Field of Classification Search
CPC . F01L 1/0047; F01L 1/14; F01L 1/146; F01L 1/34; F01L 13/00; F01L 13/06
(Continued)

(56) References Cited

U.S. PATENT DOCUMENTS

2005/0247278 A1* 11/2005 Koshimizu ..... F01L 1/022 123/90.16
2006/0005796 A1* 1/2006 Janak ..... F01L 1/181 123/90.16
(Continued)

FOREIGN PATENT DOCUMENTS

DE 209739 C 5/1909
DE 10 2013 009 757 A1 12/2014
(Continued)

OTHER PUBLICATIONS

PCT/EP2015/001025, International Search Report dated Sep. 1, 2016 (Three (3) pages).

*Primary Examiner* — Erick R Solis
*Assistant Examiner* — Robert A Werner
(74) *Attorney, Agent, or Firm* — Crowell & Moring LLP

(57) ABSTRACT

A valve train device includes a camshaft, a first valve actuating unit for actuating at least one first gas exchange valve, and a second valve actuating unit for actuating at least one second gas exchange valve. The first valve actuating unit has at least one first release element connected to the camshaft for conjoint rotation and the second valve actuating unit has at least one second release element connected to the camshaft for conjoint rotation. The release elements are coupled to each other.

7 Claims, 4 Drawing Sheets

(58) Field of Classification Search
USPC ..... 123/90.15–90.18, 321
See application file for complete search history.

(56) References Cited

U.S. PATENT DOCUMENTS

| | | | | |
|---|---|---|---|---|
| 2013/0025554 | A1 | 1/2013 | Werler et al. | |
| 2016/0298508 | A1* | 10/2016 | Lahr | F01L 1/053 |
| 2018/0142585 | A1* | 5/2018 | Lahr | F01L 13/065 |

FOREIGN PATENT DOCUMENTS

| | | | |
|---|---|---|---|
| DE | 10 2013 019 000 | A1 | 5/2015 |
| EP | 1 598 530 | A1 | 11/2005 |
| WO | WO 2013/053416 | A1 | 4/2013 |

* cited by examiner

VALVE TRAIN DEVICE, INTERNAL COMBUSTION ENGINE COMPRISING A VALVE TRAIN DEVICE AND METHOD FOR OPERATING A VALVE TRAIN DEVICE

BACKGROUND AND SUMMARY OF THE INVENTION

The present invention refers to a valve train device, an internal combustion engine comprising a valve train device and a method for operating a valve train device.

DE 10 2013 019 000 A1 already describes a valve train device having a camshaft, having a first valve actuating unit for actuating two first gas exchange valves, which are provided to convert a rotary dements motion of the camshaft into a force for switching between two different cam followers associated with the first gas exchange valves, and having a second valve actuating unit for actuating two second gas exchange valves, which is provided to convert a rotary elements motion of the camshaft into a force for switching between two different cam followers associated with the second gas exchange valves, wherein the first valve actuating unit has at least one release element connected to the camshaft for conjoint rotation and the second valve actuating unit has at least one release element connected to the camshaft for conjoint rotation.

The object of the invention is in particular to provide a mechanically simple and economic valve train device.

The invention is based on a valve train device having at least one camshaft, having a first valve actuating unit for actuating at least one first gas exchange valve, which is provided to convert a rotary elements motion of the camshaft into a force for switching between two different cam followers associated with the at least one first gas exchange valve, and having a second valve actuating unit for actuating at least one second gas exchange valve, which is provided to convert a rotary elements motion of the camshaft into a force for switching between two different cam followers associated with the at least one second gas exchange valve, wherein the first valve actuating unit has at least one release element connected to the camshaft for conjoint rotation, and the second valve actuating unit has at least one release element connected to the camshaft for conjoint rotation.

It is now proposed that the release elements are coupled to each other. In this way, a common control of the release elements for at least two cylinders of the internal combustion engine may be provided. Thus, common components for controlling the release elements may be used and the number of components may be reduced. A mechanically simple and economic valve train device may be obtained. The term "provided" is in particular to be construed as indicating a specific adaptation, provision, equipment and/or arrangement. A "cam follower" means, in this context, an element, which is provided for converting, by contacting a cam of the camshaft, a rotary elements motion of the camshaft into a linear motion for actuating a gas exchange valve. A "release element" means, in this context, an element, which is provided for releasing a mechanical switching of a valve actuating unit between the two cam followers. In particular, the release element, when actuated, is transferred into a state, in which, through a rotation of the camshaft, it actuates a switching element of the valve actuating unit, which switches the valve actuating unit between the two cam followers, wherein a time of actuating the switching element of the valve actuating unit after the release by the release element is predetermined by an angular position of the camshaft.

It is also proposed that the release elements are arranged with a phase offset relative to each other. In this way, an adapting to an ignition sequence of the different cylinders may be obtained. In particular the release elements may be mounted on a common supporting component, whereby a coupling of the release elements may be easily achieved. A "phase offset" in this context means that the as elements ire arranged within different angular ranges relative to the camshaft.

It is also proposed, that the valve train device has a switch rod, which is connected for conjoint rotation but in an axially sliding way to the camshaft, and to which the release elements are coupled. In this way, the rotary elements motion and thus the torque of the camshaft may be easily used for providing an actuating force, through which the release elements cause the activation of the switching of the cam followers. Moreover, by an axial displacement of the switch rod, a simple switching motion for controlling the release elements may be achieved.

It is also proposed, that the switch rod is guided within the camshaft. In this way, the valve train device may occupy a reduced mounting space. Moreover, a constructively simple connection of an actuator for actuating the switch rod may be achieved in a position, in which a large mounting space is provided.

It is also proposed that the valve train device comprises a third valve actuating unit having at least one release element, which is coupled to the release elements. In this way, a further reduction of the number of components for the valve train device may be obtained. A mechanically simple and economic valve train device may be provided. Moreover, a valve train device may be provided, which may be used with particular advantage in an internal combustion engine, having a six-cylinder in-line arrangement, in which three cylinders are grouped, respectively, and are operated in a common operating way.

It is also proposed that the valve train device has a further valve actuating unit, having at least a further release element, which is connected to the camshaft for conjoint rotation, which is decoupled from the at least one release element of the first valve actuating unit and the at least one release element of the second valve actuating unit. In this way, a separate control for the further valve actuating unit may be achieved.

Moreover, it is proposed, that the valve train device comprises a further switch rod, which is connected for conjoint rotation but in an axially sliding way to the camshaft, and to which the further release element is coupled. In this way, the rotary elements' motion and thus the torque of the camshaft may be easily used for providing an actuation force, through which the release elements cause the switching of the cam followers. Moreover, through an axial displacement of the switch rod, a simple switching motion for controlling the release elements may be obtained.

The invention also refers to an internal combustion engine having a valve train device according to the invention, in this way, a common control of the release elements for switching between cam followers in valve actuating units for at least two cylinders of the internal combustion engine may be achieved. In this way, common components may be used for controlling the release elements reducing the number of components. A simple and economic valve train device may be obtained.

Moreover, it is proposed that the internal combustion engine has an in-line arrangement of six cylinders. In this way, the common control of the release elements may be obtained, in a particularly simple way, for switching between cam followers, in valve actuating units for at least two cylinders of the internal combustion engine, due to the in-line arrangement. In particular, in an in-line arrangement of six cylinders, three cylinders are always operating in the same operating condition, so that the valve train device in the case of an in-line arrangement of six cylinders, in particular when the valve train device is provided with a third release element, which is coupled to the release elements, may be operated in a particularly advantageous way.

The invention also refers to a method for operating a valve train device having at least one camshaft, having a first valve actuating unit for actuating at least one first gas exchange valve, which is provided to convert a rotary elements motion of the camshaft into a force for switching between two different cam followers associated with the at least one first gas exchange valve, and having a second valve actuating unit for actuating at least one second gas exchange valve, which is provided to convert a rotary elements motion of the camshaft into a force for switching between two different cam followers associated with the at least one second gas exchange valve, wherein the first valve actuating unit has at least one release element connected to the camshaft for conjoint rotation, and the second valve actuating unit has at least one release element connected to the camshaft for conjoint rotation.

It is proposed that the release elements are simultaneously operated and the release elements trigger a successive switching of the associated valve actuating unit between the cam followers. In this way, a common control of the release elements for at least two cylinders of the internal combustion engine may be achieved. In this way, common elements for controlling the release elements may be used, reducing the number of components. A mechanically simple and economic valve train device may be obtained.

Further advantages are obtained from the following description of the figures. In the figures, an exemplary embodiment of the invention is shown. The figures, the description of figures and the claims contain various combined characteristics. Advantageously, the skilled in the art may also consider the characteristics individually, grouping the same in order to form further advantageous combinations.

DETAILED DESCRIPTION OF THE DRAWINGS

FIGS. 1 to 4 show a valve train device 10 having a cam shaft 11 The valve train device 10 is part of an internal combustion engine of a commercial transport vehicle, not shown in detail, such as a lorry. The internal combustion engine is configured as an in-line six-cylinder engine. The cam shaft 11 comprises cams 12, 13, 14, 15, 16, 17, 12', 13', 14', 15', 16', 17'. Two cams 12 and 13, 14 and 15, and 15, 16 and 17, 12' and 13', 14' and 15', 16' and 17' are grouped to a cam group. Each cam group is associated to a cylinder of the internal combustion engine. The internal combustion engine is a six-cylinder inline motor. The cam groups comprise a respective firing cam, which is associated to a firing operation of the internal combustion engine, and a braking cam, which is associated to a braking operation of the internal combustion engine. The cams 12, 14, 16, 12', 14' 16' are braking cams, whereas the cams 13, 15, 17, 13', 15', 17' are firing cams. During the firing operation, a compression work is used within the cylinder in particular for propulsion. In the braking phase, the compression work within the cylinder is used for braking. The cam shaft 11 is provided for use as an inlet camshaft. In an alternative embodiment, it may also be used as an outlet camshaft. In further embodiments, the cams 12, 14, 16, 12', 14', 16' may be adapted for operating as respective firing cams providing different valve strokes, instead of braking and firing cams.

Figure 1:
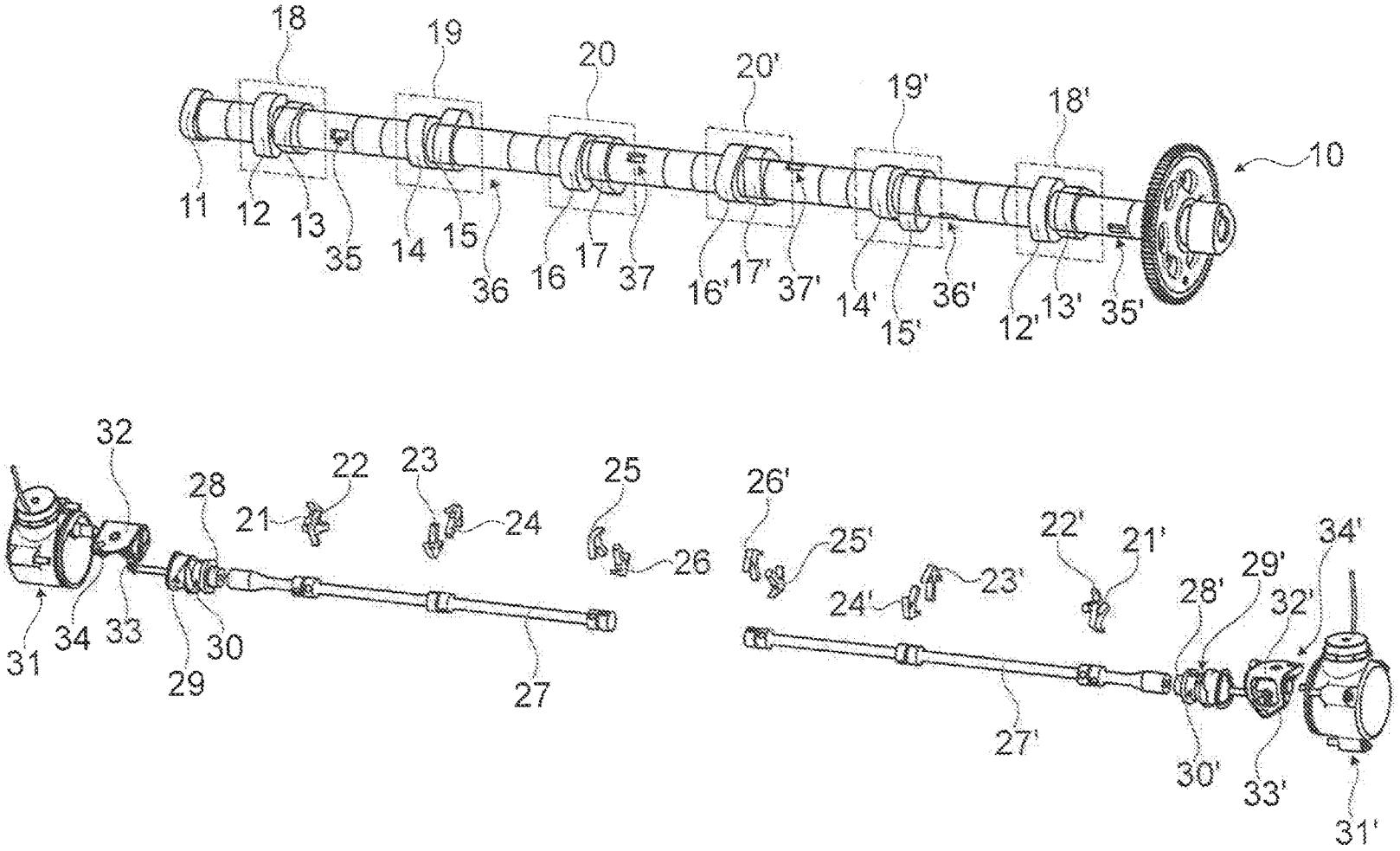
FIG. 1 shows an exploded view of the valve train device.
Figure 2:
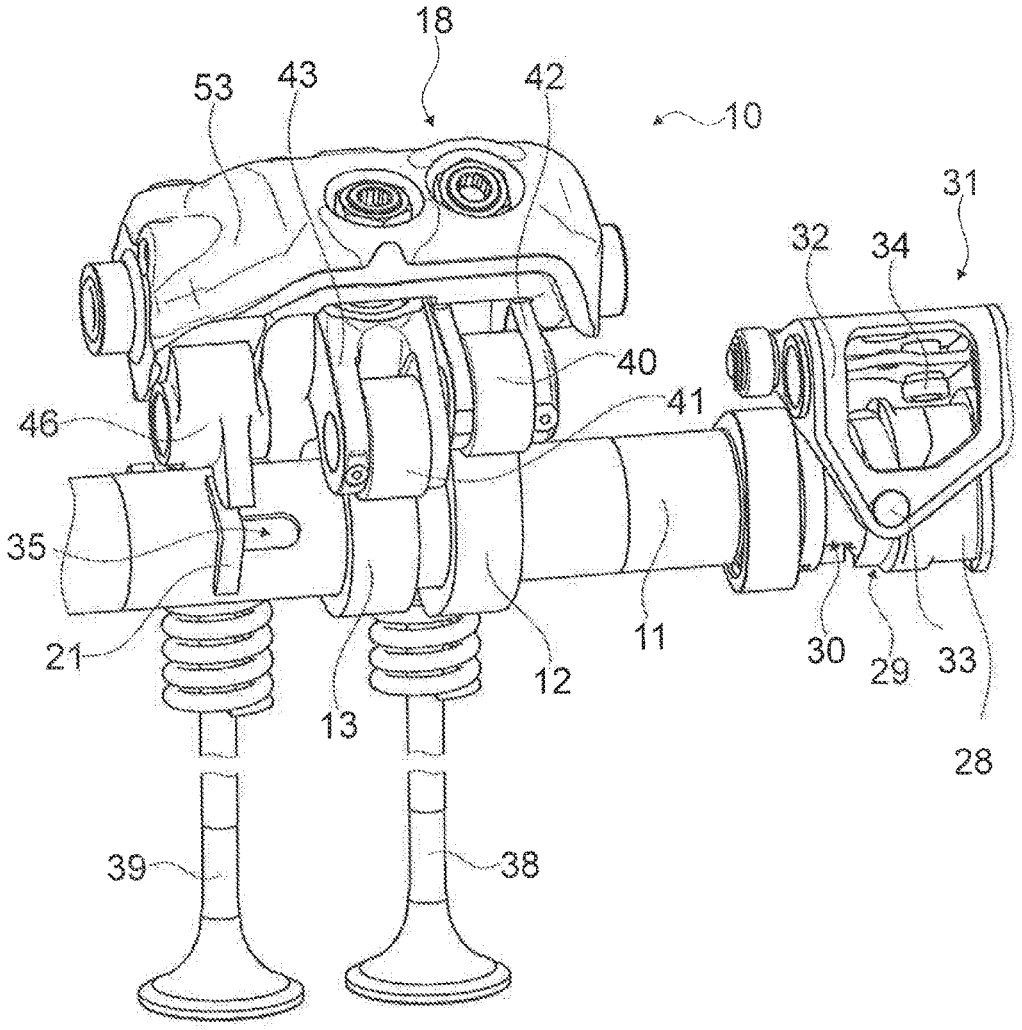
FIG. 2 shows a detailed view of the first valve actuating unit.

The valve train device 10 has a first valve actuating unit 18 for actuating first gas exchange valves 38, 39 (see FIG. 2). The two first gas exchange valves 38, 39 are coupled to each other. The first valve actuating unit 18 engages during braking operation with the cam 12 configured as a braking cam and in the firing mode the cam 13 configured as a firing cam. When engaging the cam 12 or the cam 13, the first valve actuating unit 18 actuates the first gas exchange valves 38, 39 together due to their coupling. Alternatively, the first valve actuating unit 18 may be provided for actuating only a single gas exchange valve 38 or for actuating more than two first gas exchange valves 38, 39. The first valve actuating unit 18 comprises two different cam followers 40, 41 associated to the two first gas exchange valves 38, 39 and is provided for converting a rotary elements motion of the camshaft 11 into a force for switching between the two different cam followers 40, 41 associated with the two first gas exchange valves 38, 39.

The cam follower 40 is provided for engaging the cam 12 configured as a braking cam, and the cam follower 41 is provided for engaging the cam 13 configured as a firing cam. In braking operation, the valve operating unit 18 actuates the gas exchange valves 38, 39 in a braking operation by engaging the cam 12 through the cam follower 40 while the cam 13 passes under the cam follower 41. During braking operation, the valve operating unit 18 actuates the gas exchange valves 38, 39 in firing operation by engaging the cam 13 through the cam follower 41 while the cam 12 passes under the cam follower 40. During firing operation, a crankshaft is driven due to a combustion process in the cylinders and in the braking operation it is decelerated due to an unused compression of compression air in the cylinders. The firing and the braking operating mode differ in this case in control times for the first gas exchange valves 38, 39.

The first valve actuating unit 18 has a first release element 21 connected to the camshaft 11 for conjoint rotation. The release element 21 is configured as a switching cam, which is partially disposed within the camshaft 11 and projects beyond the camshaft 11. The release element 21 has an inner contour with wedge flanks, which is rounded and provided to apply the release element 21 accurately against the camshaft 11. The camshaft 11 has a slot 35 through which the release element 21 protrudes. The slot 35 is made by a laser cutting method. Alternatively, the slot 35 may be made by another method, such as a punching or milling process. The release element 21 is provided to trigger a switching of the valve actuating unit 18 between the cam followers 40, 41 in a first switching direction. The first valve actuating unit 18 has a second release element 22 connected to the camshaft 11 for conjoint rotation, which is to trigger a switching of the valve operating unit 18 between the cam followers 40, 41 in a second switching direction, which is opposite to the first switching direction. The second release element 22 protrudes from a further slot, not shown, from the camshaft 11.

The first release element 21 and the second release element 22 are arranged with an angular offset from each other.

Figure 3:
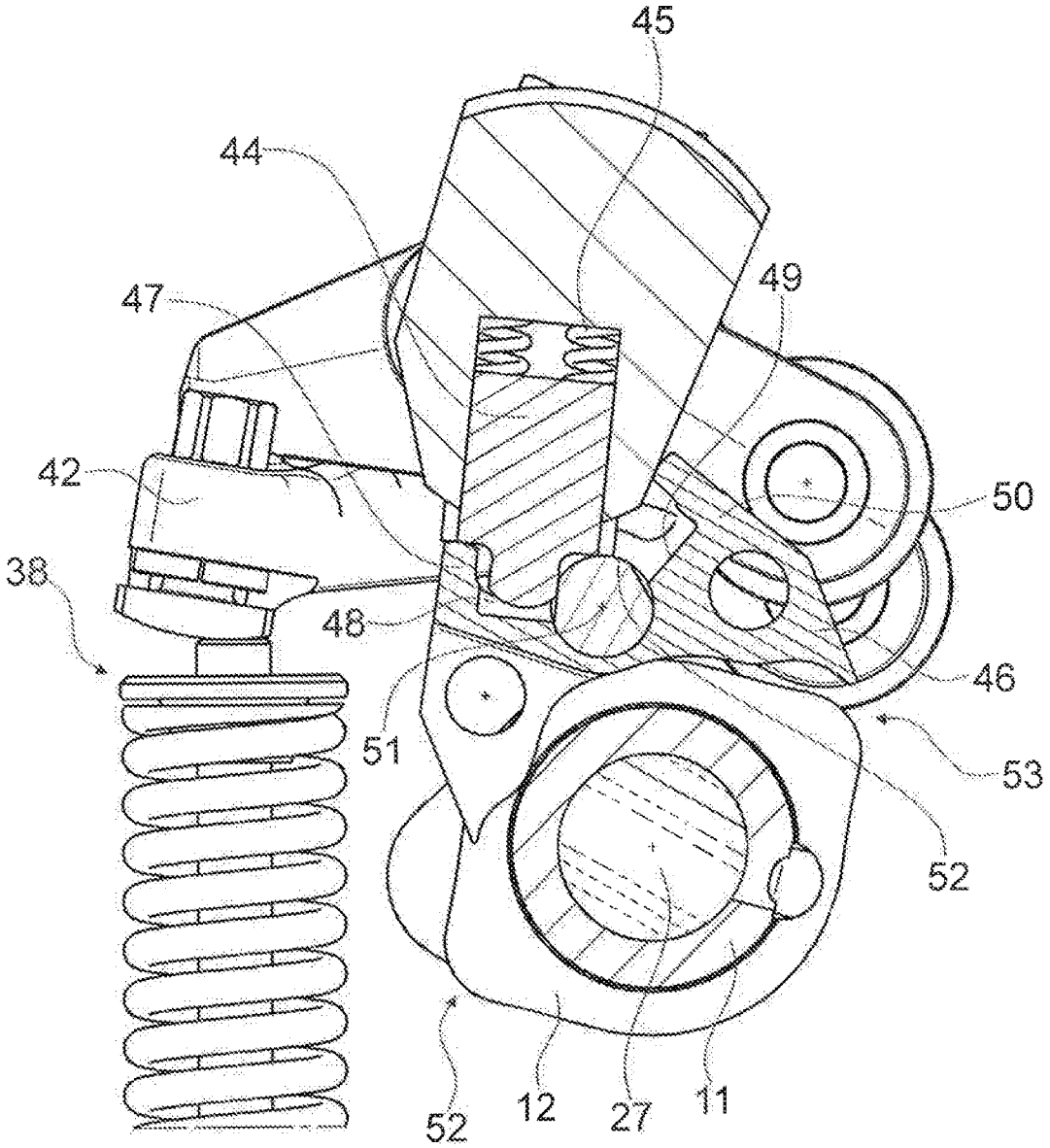
FIG. 3 shows a section of the valve actuating unit, which is switched into a firing operation.
Figure 4:
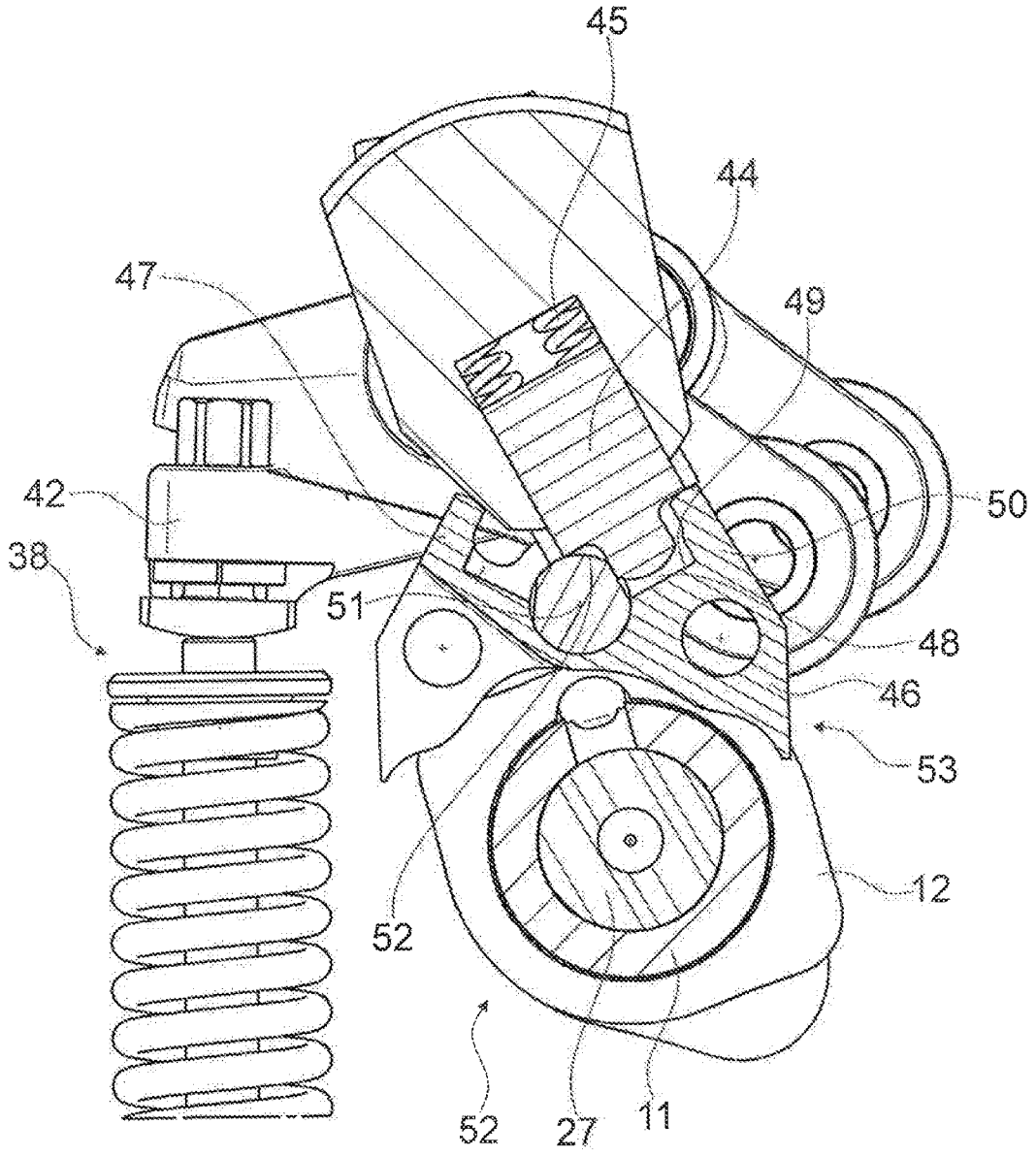
FIG. 4 shows a section of the valve actuating unit, which is switched into a braking operation.

The valve actuating unit 118 has two tilting levers 42, 43, which are configured as a roller tilting lever having the cam followers 40, 41. For switching between the cam followers 40, 41, the valve actuating unit 18 has a tilting lever bearing which has a first end position associated to the firing mode and a second end position associated to the braking mode. In the first end position, the cam follower 41 provided for the firing operation of the gas exchange valves 38, 39 is in constant contact with the cam 13 (FIG. 3) configured as a firing cam. The cam follower 40 provided for braking operation of the gas exchange valves 38, 39, however, is lifted from the cam 12 configured as a braking cam, whereby the cam 12 passes without effect under the cam follower 40. In the second end position, conversely, the cam follower 40 provided for the braking operation of the gas exchange valves 38, 39 is in constant contact with the cam 12 designed as a braking cam, while the cam follower 41 provided for the firing operation of the gas exchange valves 38, 39 is lifted from the cam 13 configured as a firing cam, whereby the cam 13 passes without effect under the cam follower 41 (FIG. 4).

The tilting lever bearing comprises a bearing element 53, on which the tilting lever 42, 43 is supported. The bearing element 53 itself is supported in a tilting way. The bearing element 53 is provided as a U-shaped bracket, wherein the tilting levers 42, 43 are attached to a part of the bearing element 53, which is essentially parallel to the camshaft 11. The tilting lever bearing is provided for switching by the rotary elements motion of the cam shaft 11. If the bearing element 53 is switched in the first end position, then, in case of actuation of the gas exchange valves 38, 39 by the firing cam 13, the bearing element 53 is essentially subject to a force, which is directed in the direction of the second end position (FIG. 3). If the bearing element 53 is switched in the second end position, an actuation of the gas exchange valves 38, 39 by the braking cam 12 causes a force on the bearing element 53, which is essentially directed in the direction of the first end position (FIG. 4).

The force acting on the bearing element 53, which is used for switching between both end positions, results from an actuating force, which is exerted in the firing mode and in the braking mode of operation by the cam shaft 11 on the gas exchange valves 38, 39. The bearing element 53 contrasts this actuating force. The tilting levers 42, 43 have tilting lever axes, which are offset to each other, about which the tilting levers 42, 43 are supported in a tilting way with respect to the bearing element 53. Due to the fact that the axes of the tilting levers are offset to each other, depending on the tilting lever 42, 43, by which the gas exchange valves 38, 39 are actuated, a different force acts on the bearing element 53. The bearing element 53 has a bearing axis, which is effectively positioned between both tilting lever axes. If the one tipping lever 42 is actuated, then the actuating force of this tipping lever 42 causes a torque acting on the bearing element 53, which is directed in the opposite direction with respect to the bearing axis of the bearing element 53, relative to torque resulting from the actuating force of the other tipping lever 43, which acts on the bearing element 53, when the other tipping lever 43 is actuated.

In order to fix the tilting lever bearing, the valve actuating unit 18 has a spring loaded latching engagement element 44, which is provided for fixing the bearing in both end positions. The latching engagement element 44 is supported in an axially movable way with respect to the bearing element 53. The valve actuating unit 18 has a spring element 45, which is positioned between the bearing element 53 and the latching engagement element 44.

For an effective connection with the latching engagement element 44, the valve actuating unit 18 comprises a latching profile element 46, against which the latching engagement element 44 abuts. For the form fitting connection with the latching engagement element 44, the latching profile element 46 comprises a latching profile, with two recesses 48, 49 between two abutments 47, 50. Between the two recesses 48, 49 a ridge 52 is positioned. The latching profile element 46 has a bearing axis 51, which forms the ridge 52. The first recess 48, which is associated to the first end position in firing operation, lies between the first abutment 47 and the ridge 51. The second recess 49, which is associated to the second end position in braking operation, lies between the second abutment 50 and ridge 52. Recesses 48, 49 define two latching positions, in which the latching engagement element 44 and the latching profile element 46 are connected to each other with a form fit.

A swiveling motion of the bearing element 53 is delimited by the two mechanical abutments 47, 50, which define both end positions of the tilt lever bearing. In case of a swivel motion of the bearing element 53 from the second end position in braking mode into the first end position in firing mode, abutments 47, 50 delimit the swiveling motion of the bearing element 53, in that the abutment 50 abuts against the bearing element 53 and the abutment 47 abuts against the latching engagement element 44. Thus, abutments 47, 50 restrict the swiveling motion of the bearing element 53 from the first end position in the firing mode into the second end position in braking mode, in that now the abutment 47 abuts against the bearing element 53 and abutment 50 abuts against the latching engagement element 44. The latching engagement element 44 is movably connected to the bearing element 53. In case of motion of the bearing element 53 from the one end position into the other end position, the latching engagement element 44 is moved from the one recess 48, 49 through ridge 52 into the other recess 49, 48. In end positions, the latching engagement element 44 and the latching profile element 46 fix the bearing element 53 against torque acting during actuation of gas exchange valves 38, 39. A spring force, which is provided by the spring element 45 held between the latching engagement element 44 and the bearing element 53, is sufficient to support the torque resulting from the actuating force of the gas exchange valves 38, 39 against ridge 52, so that the latching engagement element 44 does not switch from a recess 48, 49 into the respective other recess 49, 48.

The movably supported latching profile element 46 may be rotated between the first latching position, associated to the firing mode (FIG. 3) and the second latching position, associated to the braking mode (FIG. 4). In the first latching position of latching profile element 46, the bearing element 53 is in its first end position in firing mode, wherein the latching engagement element 44 engages the first recess 48 of the latching profile. In the second latching position of the latching profile element 46, the bearing element 53 is in its second end position in braking mode, wherein the latching engagement element 44 engages the second recess 49 of latching profile. In the latching positions, one of recesses 48, 49 of latching profile element 46 for the latching engagement element 44 forms a global minimum, in which the latching engagement element 44 is guided when the actuating force for the gas exchange valves 38, 39 is supported through the bearing element 53 against the cam shaft 11. The latching profile element 46 has an intermediate position, which is a central position between the two latching positions. If the latching profile element 46 is rotated in the central position, then the latching engagement element 44 moves into the latching profile. The latching engagement element 44 moves then within the latching profile from the corresponding recess 48, 49 on the ridge 52. Since the latching profile element 46 is rotated simultaneously, the intermediate position forms an unstable position.

Depending on which latching positions the latching profile element 46 is switched within, the bearing element 53 for the tilting lever 42, 43 is switched at the successive actuation of gas exchange valves 38, 39 in the end position corresponding to the latching position. The switching between firing and braking mode occurs in that the latching profile element 46 is rotated from the one to the other latching position. A rotation is obtained through the release element 21. The latching profile element 46 has a side facing the cam shaft 11 which forms an actuation profile for rotating by means of the torque of the cam shaft 11.

The actuation profile has two tracks, which are offset to each other along a rotational axis of the cam shaft 11. Depending on the switching position of the release elements 21, 22, the first release element 21 of the first valve actuating unit 18 engages the one track of the actuation profile or the second release element 22 of the first valve actuating unit 18 engages the other track on the actuation profile. The tracks are formed by oblique tracks with respect to a rotary elements motion of the release elements 21, 22 about the rotary elements axis of the cam shaft 11. The actuation profile of the latching profile element 46 is adapted to convert the torque acting on the first 21 or second release element 22 of the cam shaft 11 into a torque acting on the latching profile element 46, in order to rotate the latching profile element 46 about its bearing axis 51. The release elements 21, 22 are adapted, in cooperation with the actuation profile of latching profile element 46, to switch, in a first switching position, the latching profile element 46 from the first latching position of firing mode into the intermediate position. The first release element 21 engages the track of actuation profile. In a second switching position, the latching profile element 46 switches from the second latching position of braking mode into the intermediate position. The second release element 22 is thus displaced into the other rack of the profile. The release elements 21, 22 are thus adapted only to switch the latching profile element 46 in the intermediate position. The latching engagement element 44 is then guided from the intermediate position into the other latching position, when the actuating force on gas exchange valves 38, 39, which results from a rotation and the torque of cam shaft 11, at the following actuation of gas exchange valves 38, 39, is supported through the bearing element 53 against the cam shaft 11.

The valve train device 10 has a second valve actuating unit 19 for actuating two second gas exchange valves. The second valve train device 10 has a construction similar to the first valve actuating unit 18. The second valve actuating unit 19 is also adapted to convert a rotary elements motion of the cam shaft 11 into a force for switching between two different cam followers associated to the second gas exchange valves. The second valve actuating unit 19 has a first release element 23 connected to the cam shaft 11 for conjoint rotation and a second release element 24 connected to the cam shaft 11 for conjoint rotation. The two release elements 23, 24 are adapted for performing the same function for the second valve actuating unit 19 as the two release elements 21, 22 in the first valve actuating unit 18. The cam shaft 11 has a slot 36, through which the first 23 protrudes from the cam shaft 11.

The release elements 21, 23, 24 are coupled to each other. A simultaneous actuation of the release elements 21, 22, 23, 24 is obtained through the coupling. At actuation, the release elements 21, 22, 23, 24 are positioned simultaneously with an axial switching movement, in which position they may trigger the switching of the cam follower 40, 41 of the valve actuating units 18, 19. The actual switching is triggered subsequently in different angular positions of cam shaft 11 through the rotation of cam shaft 11.

The release elements 21, 22, 23, 24 are positioned with a phase offset to each other. Due to the phase offset, after triggering the switch, a successive switching in the ignition sequence of cylinders is obtained. The release elements 23, 24 have a phase offset of 240 degrees, in the direction of rotation of cam shaft 11, in order to provide a switching according to the ignition sequence 1-5-3-6-2-4 of internal combustion motor.

The valve train device 10 has a switching rod 27 connected to the cam shaft 11 for conjoint rotation but in an axially movable way, to which the release elements 21, 22, 23, 24 are coupled. Due to an axial switching motion of switching rod 27, the release element 21 is switched back and forth between the first and second switching position, so that the release element 21 switches the latching profile element 46 into the intermediate position. Due to the same switching motion of the switching rod 27 the release elements 21, 22, 23, 24 are switched back and forth between the first and second switching position.

The switching rod 27 is guided within the cam shaft 11 and forms an inner shaft of cam shaft 11. The release elements 21, 22, 23, 24 are solidly connected to the switching rod 27. The release elements 21, 22, 23, 24 are positioned on the edges of the slots 35, 36 and with an inner profile of an arrow region on the cam shaft 11 and connect the switching rod 27 for conjoint rotation but in an axially movable way to the cam shaft 11. When mounting the valve train device 10 the switching rod 27 is held within the cam shaft 11, and subsequently the release elements 21, 22, 23, 24 are inserted through the slots 35, 36 on the switching rod 27. The release elements 21, 22, 23, 24 then hold the switching rod 27 for conjoint rotation, but in an axially movable way on the cam shaft 11.

The valve train device 10 comprises a slotted link element 28 with sliding tracks 29, 30 for generating the axial switching motion of switching rod 27. The slotted link element 28 is adapted for converting a rotation of the cam shaft 11 into a linear switching motion of the slotted link element 28. The slotted link element 28 is positioned frontally on the switching rod 27, so that the linear switching motion of the slotted link element 28 causes the axial switching motion of the switching rod 27. The axial switching motion of the switching rod 27 is thus also generated by the rotary elements motion of the cam shaft 11.

The valve train device 10 comprises an actuator 31 with two pins 33, 34, which are adapted for engaging in the tracks 29, 30 and convert the rotary elements motion of the cam shaft 11 into a linear switching motion of the slotted link element 28. The actuator 31 comprises a lever 32, to which the pins 33, 34 are positioned. The lever 32 supports the pins 33, 34 about a common swivel axis, which is parallel to a rotation axis of the slotted link element 28, which coincides with the rotation axis of the cam shaft 11. Pins 33, 34 are supported by the lever 32 in a way that at any one time only one of pins 33, 34 engages the tracks 29, 30 and the other pin 34, 33 is lifted from the slotted link element 28. The pin 33 is associated to the track 29, the pin 34 to track 30.

The sliding tracks 29, 30 respectively have an oblique segment with an axial component, which causes, in case of engagement of pins 33, 34 an axial displacement of the slotted link element 28, and an enveloping region without an axial component. The oblique segment with the axial component extends only along part of an angular region of the slotted link element 28. In case of changing the tracked pins 33, 34, the new pin 33, 34 to be tracked is inserted in the oblique segment with the axial component and thus causes the axial displacement of the slotted link element 28. After traveling along the oblique segment, the pin 33, 34 travels in the enveloping region without an axial component of track 29, 30, whereby the slotted link element 28 is fixed in an axial position. The oblique regions of tracks 29, 30 are opposite, so that they cause axial displacements in opposite directions.

For switching between the tracked pins 33, 34, the actuator 31 is operated electromagnetically and has a coil. If the coil is not energized, then pin 33 is tracked in track 29 and pin 34 is lifted by lever 32 from slotted link element 28. By energizing the coil, the pin 33 is attracted to the coil and lifted from slotted link element 28. By rotating the lever 32 about the common swivel axis, pin 34 is brought in contact with slotted link element 28, whereby pin 34 is inserted into track 30 and slotted link element 28 is axially displaced with the switching rod 27. After de-energizing the coil, due to spring force, the pin 33 is again pressed against the slotted link element 28, whereby pin 34 lifts from slotted link element 28. Pin 33 inserts into track 29 and triggers, by travelling along the oblique region of track 29 an opposite axial displacement of slotted link element 28.

The valve train device 10 has a third valve actuating unit 20 for actuating two third gas exchange valves, which is identical to the first valve actuating unit 18. The third valve actuating unit 20 has two release elements 25, 26 connected to the cam shaft 11 for conjoint rotation, which are provided for triggering a switching between two different cam followers associated to the second gas exchange valves. The release elements 25, 26 of third valve actuating unit 20 are adapted for performing the same function for the third valve actuating unit 20 as the release elements 21, 22 for the first valve actuating unit 18. The cam shaft 11 has a slot 37, through which the release element 25 protrudes from the cam shaft 11.

The release element 25 is also positioned on the switching rod 27 guided in the cam shaft 11. By means of the switching rod 27 it is possible for the actuator 31 to simultaneously trigger the release elements 21, 22, 23, 24 for the three valve actuating units 18, 29, 20. The release element 21 then triggers the switching for the cam followers 40, 41 of the first valve actuating unit 18, as soon as it is brought into contact with the actuation profile of the latching profile element 46 by rotation of cam shaft 11, and switches the latching profile element 46 into the intermediate position. As soon as the engaged cam 12, 13 then runs against the respective engaging cam follower 40, 41, the bearing element 53 is tilted by the actuation force from the rotation of cam shaft 11 and the engaging cam follower 40, 41 is switched. The switching is then ended for the first valve actuating unit 18. The same process is triggered by the release elements 23, 25 for the valve actuating units 19, 20.

The release elements 25, 26 of the third valve actuating unit 20 are positioned with a phase offset of 120 degrees in the rotation direction of cam shaft 11 with respect to first release elements 21, 22. The switching of the third valve actuating unit 20 between the followers is thus performed, according to the ignition sequence, before a switching of the second valve actuating unit 19.

The valve train device 10 has a further valve actuating unit 18' for actuating two further gas exchange valves, which are adapted for converting a rotation of the cam shaft 11 into a force for switching between two different cam followers, which are associated to the further gas exchange valve, with two further release elements 21', 22' connected to the cam shaft 11 for conjoint rotation. The two further release elements 21', 22' conjointly connected to the cam shaft 11 are decoupled from the first release elements 21, 22 and the second release elements 23, 24. The further valve actuating unit 18' is thus switchable independently from the first valve actuating unit 18 and second valve actuating unit 19. The further valve actuating unit 18' is identical to the first valve actuating unit 18. The release element protrudes through a slot 35' from the cam shaft 11.

The valve train device 10 has a further switching rod 27', which is connected to the cam shaft 11 for conjoint rotation but in an axially movable way, which is guided within the cam shaft 11 and is coupled to the further release elements 21', 22'. The switching rod 27' is similar to switching rod 27 and is adapted for performing an axial switching motion, through which the release element 21' is switched back and forth between a first and second switching position. Due to switching between the switching positions, a switching of the further valve actuating unit 18' is triggered as in the case of the first valve actuating unit 18. The switching rod 27 and the further switching rod 27' have an identical length, which is shorter than half the length of the cam shaft 11.

The valve train device 10 comprises a further actuator 31' with a sliding link element 28' with two tracks 29', 30' and a lever 32' with two pins 33', 34', which is connected to the further switching rod 27' and which is identical to the actuator 31 connected to the switching rod 27. The actuator 31' is adapted for converting the rotation of cam shaft 11 into a linear switching motion of the further switching rod 27' for triggering the switching between the cam followers of valve actuating unit 18' through the release element 21'.

The valve train device 10 has a second further valve actuating unit 19' for actuating two further gas exchange valves and a third further valve actuating unit 20' for actuating further two third gas exchange valves, which are similar to further valve actuating unit 18'. The second valve actuating unit 19' and the third further valve actuating unit 20' have release elements 23', 24, 25, 26' conjointly connected to the cam shaft 11, which are provided for performing the same function for the second further valve actuating unit 19' and the third further valve actuating unit 20' as the first further release elements 21', 220 for the first further valve actuating unit 18'. The further release elements 23', 24' are coupled to the further switching rod 27'.

The valve train device 10 with the valve actuating units 18, 19, 20, 18', 19', 20' is adapted for use in an internal combustion engine, which has a in-line arrangement of six cylinder. Basically, by adapting a number of valve actuating units 18, 19, 20, 18', 19', 20', it is possible to use the valve train device 10 also for internal combustion engines with an in-line arrangement of four cylinders or eight cylinders. The valve train device 10 may also be used for a V-six cylinder, wherein three cylinders are respectively positioned on a flank of a V shape.

In a method for operating the valve train device 10, the release elements 21, 22, 23, 24, 25, 26 are simultaneously operated. The simultaneous operation of the release elements 21, 22, 23, 24, 25, 26 is obtained by the switching rod 27, on which the release elements 21, 22, 23, 24, 25, 26 are positioned. The switching rod 27 is displaced in an axial direction by the actuator 31 and the sliding link element 28, which converts the rotation of cam shaft 11 into the linear switching movement of the sliding link element 28 connected to the switching rod 27. The release elements 21, 22, 23, 24, 25, 26 trigger a subsequent switching of the associated valve actuating units 18, 19, 20 between the cam followers 40, 41. The subsequent switching is obtained by the phase offset between the release elements 21, 22, 23, 24, 25, 26, through which the release elements 21, 22, 23, 24, 25, 26 engage at different times the actuation profile of the latching profile element 46 of the respective valve actuating unit 18, 19, 20 and trigger the switching. The subsequent switching is adapted to the ignition sequence of cylinders, to which the valve actuating units 18, 19, 20 are associated. In the method for operating the valve train device 10, the release elements 21', 22', 23', 24', 25', 26' are actuated also simultaneously. The release elements 21', 23', 24', 25', 26' also trigger a subsequent switching of the associated valve actuating units 18', 19', 20' between the cam followers.

LIST OF REFERENCE CHARACTERS

10 valve train device
11 camshaft
12 cam
13 cam
14 cam
15 cam
16 cam
17 cam
18 valve actuating unit
19 valve actuating unit
20 valve actuating unit
21 release element
22 release element
23 release element
24 release element
25 release element
26 release element
27 switching rod
28 slotted link element
29 sliding track
30 sliding track
31 actuator
32 lever
33 pin
34 pin
35 slot
36 slot
37 slot
38 gas exchange valve
39 gas exchange valve
40 cam follower
41 cam follower
42 tilt lever
43 tilt lever
44 latching engagement element
45 spring element
46 latching profile element
47 abutment
48 recess
49 recess
50 abutment
51 bearing axis
52 ridge
53 bearing element

The invention claimed is:

1. A valve train device, comprising:

a camshaft;

a first valve actuating unit for actuating a first gas exchange valve, wherein the first valve actuating unit is provided to convert a rotary motion of the camshaft into a first force for switching between two first different cam followers associated with the first gas exchange valve and wherein the first valve actuating unit has a first release element connected to the camshaft for conjoint rotation;

a second valve actuating unit for actuating a second gas exchange valve, wherein the second valve actuating unit is provided to convert the rotary motion of the camshaft into a second force for switching between two second different cam followers associated with the second gas exchange valve and wherein the second valve actuating unit has a second release element connected to the camshaft for conjoint rotation;

wherein the first and the second release elements are coupled to each other;

a first switch rod, wherein the first switch rod is connected to the camshaft for conjoint rotation in an axially movable way and wherein the first and the second release elements are coupled to the first switch rod; and a second switch rod, wherein the second switch rod is connected to the camshaft for conjoint rotation in an axially movable way and wherein a further release element is coupled to the second switch rod.

2. The valve train device of claim 1, wherein the first and the second release elements are disposed with a phase offset relative to each other.

3. The valve train device of claim 1, wherein the first switch rod is guided within the camshaft.

4. The valve train device of claim 1 further comprising a third valve actuating unit, wherein the third valve actuating unit has a third release element which is coupled to the first and the second release elements.

5. The valve train device of claim 1 further comprising a further valve actuating unit, wherein the further valve actuating unit has the further release element, wherein the further release element is connected to the camshaft for conjoint rotation, and wherein the further release element is decoupled from the first and the second release elements.

6. An internal combustion engine comprising the valve train device according to claim 1.

7. The internal combustion engine of claim 6 further comprising an in-line arrangement of six cylinders.

* * * * *